US007182028B1

(12) United States Patent
White

(10) Patent No.: US 7,182,028 B1
(45) Date of Patent: Feb. 27, 2007

(54) SYSTEM AND METHOD FOR THE PYROLIZATION OF WASTE

(76) Inventor: Warren E. White, 10711 Jaycreek Dr., Houston, TX (US) 77070

( * ) Notice: Subject to any disclaimer, the term of this patent is extended or adjusted under 35 U.S.C. 154(b) by 0 days.

(21) Appl. No.: 11/046,960

(22) Filed: Jan. 31, 2005

Related U.S. Application Data

(60) Provisional application No. 60/540,192, filed on Jan. 30, 2004.

(51) Int. Cl.
*F23G 5/00* (2006.01)
*F23G 5/44* (2006.01)
*F23G 7/00* (2006.01)
*F23B 7/00* (2006.01)

(52) U.S. Cl. ..... 110/229; 110/255; 110/346; 110/341; 110/342

(58) Field of Classification Search ..... 110/342, 110/341
See application file for complete search history.

(56) References Cited

U.S. PATENT DOCUMENTS 1,777,449 A * 10/1930 Rath ..... 201/2.5
1,898,326 A * 2/1933 Wahlstrom ..... 201/6
2,025,384 A * 12/1935 Gomory ..... 196/114
2,160,341 A * 5/1939 Reichert ..... 201/25
2,238,367 A * 4/1941 Mohr et al. ..... 518/703
2,481,504 A * 9/1949 Ferro et al. ..... 110/257
2,757,129 A * 7/1956 Reeves et al. ..... 201/27
2,897,146 A * 7/1959 Waddill ..... 208/364
3,110,663 A * 11/1963 Miller ..... 208/93
3,186,923 A * 6/1965 Lyness ..... 201/25
3,207,675 A * 9/1965 Gladieux ..... 196/98
3,362,887 A * 1/1968 Rodgers ..... 201/2.5
3,617,469 A * 11/1971 Schlinger et al. ..... 208/408
3,639,111 A * 2/1972 Brink et al. ..... 48/111
3,702,039 A * 11/1972 Stookey et al. ..... 48/111
3,761,586 A * 9/1973 Matsumoto et al. ..... 424/542
4,759,300 A * 7/1988 Hansen et al. ..... 110/229
5,411,714 A * 5/1995 Wu et al. ..... 422/232
5,415,112 A * 5/1995 Takahashi ..... 110/246
5,669,317 A * 9/1997 May et al. ..... 110/229

* cited by examiner

*Primary Examiner*—Kenneth Rinehart
(74) *Attorney, Agent, or Firm*—Egbert Law Offices

(57) ABSTRACT

A system for the pyrolization of waste has a combustion chamber with a fuel inlet and a hot gas outlet, a pyrolization chamber separated from the combustion chamber, and a conveyor means positioned within the pyrolization chamber for moving waste from the waste inlet through the pyrolization chamber. The pyrolization chamber is connected to the hot gas outlet of the combustion chamber. The pyrolization chamber has a waste inlet and pyrolized waste outlet. A plurality of radiant tubes are positioned within the pyrolization chamber adjacent to the conveyor so as to heat the waste on the conveyor.

16 Claims, 6 Drawing Sheets

SYSTEM AND METHOD FOR THE PYROLIZATION OF WASTE

RELATED U.S. APPLICATIONS

The present application claims priority from U.S. Provisional Application Ser. No. 60/540,192, filed on Jan. 30, 2004, and entitled "Process for the Pyrolization of Waste".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to the pyrolization of waste. More particularly, the present invention relates to pyrolization process whereby the heat for the pyrolization is obtained from an external combustion chamber. Additionally, the present invention relates to processes for the pyrolization of waste in which the various components of pyrolized waste can be recovered and reused in an economic and efficient manner.

BACKGROUND OF THE INVENTION

The pyrolization of organic materials is not a new art. There are various U.S. patents which disclose various destructive distillation, pyrolysis or cracking processes. These patents are identified as U.S. Pat. Nos. 1,777,449, 1,898,326,2,025,384, 2,160,341, 2,238,367, 2,757,129,2,897,146, 3,110,663, 3,186,923, 3,207,675, 3,362,887, 3,617,469, 3,639,111, 3,702,039, and 3,761,586. In these pyrolization processes, organic and other waste is delivered to a combustion chamber whereby the heat of combustion is directed to the waste material so as to convert the waste into gases and liquids. Ultimately, the residue wastes from the combustion chamber are removed from the combustion chamber and delivered elsewhere for disposal. In each of these pyrolization process, it is necessary to obtain an extremely high heat of combustion in order to properly effectively vaporize the organic wastes into their constituent components. Ultimately, each of these processes produces a relatively large amount of waste gases. In certain circumstances, these waste gases are discharged to the atmosphere, thereby producing undesirable environmental effects. In other circumstances, these waste gases are transported elsewhere for storage and reuse. Ultimately, throughout the history of the pyrolization of waste, it has been extremely difficult to economically dispose of waste in this manner. The cost of feed gasses, combustion liquids, and other materials tends to exceed the overall value of the constituent components produced from the process. In other circumstances, environmental regulations cause extreme financial difficulties for pyrolization institutions. The cost of environmental compliance is extremely expensive and effectively offsets the financial benefits gained from the pyrolization of waste.

Ultimately, it is very desirable to pyrolyze waste. Most importantly, the pyrolization of waste greatly minimizes the amount of landfill required for such waste. Additionally, by elevating the temperature of the waste to extremely high temperatures, any pathogens and toxic components of the waste are effectively destroyed. Ultimately, the pyrolization of waste can result in an extremely clean, pathogen-free and vector-free residue. The gases that are produced from the pyrolization process are combustible and usable under other circumstances. As such, the production of such gases can significantly offset the cost of fuel.

U.S. Pat. No. 4,038,152, issued on Jul. 26, 1977 to L. D. Atkins, teaches one type of process and apparatus for the destructive distillation of waste material. This patent describes an insulated seal distillator compartment which is provided with a plurality of conveyor stages for transporting waste material through the sealed compartment while subjecting the material to a plurality of increased zones of temperature in order to completely pyrolyze the material and evolve pyrolysis gases. An auger feed apparatus supplies a continuous supply of material to the sealed distillator, while an auger discharge apparatus removes a continuous supply of solid carbonaceous residue from the distillator. The residue can be classified and separated into usable products. The evolved gases are converted into crude oil and natural gas.

It is an object of the present invention to provide a pyrolization process that effectively pyrolyzes waste material.

It is another object of the present invention to provide a pyrolization process in which an external combustion chamber provides the heat component to the pyrolization chamber.

It is another object of the present invention to provide a pyrolization process whereby the gaseous components of the process are recycled or used as heat-generating components of the process.

It is another object of the present invention to provide a pyrolization process which re-circulates flue gases so as to provide precise control of external combustion and for nitrogen oxide emissions control.

It is an object of the present invention to provide a pyrolization process which rapidly cools the hot gas from the pyrolytic chamber so as to minimize production of undesirable pyrolitic products.

It is still a further object of the present invention to provide a pyrolization process which relies primarily upon radiant heat for the destructive distillation process.

It is a further object of the present invention to provide a pyrolization process which utilizes waste heat recovery for power generation and for cost minimization.

These and other objects and advantages of the present invention will become apparent from a reading of the attached specification and appended claims.

BRIEF SUMMARY OF THE INVENTION

The present invention is a process for the pyrolization of waste. In particular, the process of the present invention utilizes a pyrolization chamber and a combustion chamber. The pyrolization chamber includes a waste inlet whereby wastes may be introduced into the interior of the pyrolization chamber. The chamber also includes a residue solid outlet located at the bottom thereof. The pyrolization chamber also includes a pyrolized gas outlet and a radiant gas inlet and outlet.

The combustion chamber utilizes fuels produced from the pyrolization process, along with fuels introduced external from the process. These fuels can be gases and liquids that are mixed with air so as to achieve maximum heating value. The hot gas outlet of the combustion chamber communicates with the radiant tubes through a tubular header in the pyrolization chamber. As a result, the combustion gases will flow in a closed system so as to create heat transfer to the waste materials within pyrolization chamber. Ultimately, a portion of the cooled gases from the heating tubes within the pyrolization chamber are recirculated to the combustion chamber for reheating and heat exchange.

A transport deck is provided within the pyrolization chamber so as to transport the waste therethrough in a desired manner. In the preferred embodiment of the present invention, the transport deck includes at least one conveyer which serves to pass the waste from the waste inlet through the interior of the pyrolization in heat-exchange relationship with the conveyor support decks therein. As a result, a heat exchange relationship will occur between the conveyor support decks and the wastes located on the conveyers. In the preferred embodiment of the present invention, multiple conveyers are located on multiple layers within the pyrolization chamber. Baffles are provided on the interior of the chamber so as to direct waste from one level or layer of the conveyers to another level or layer. The radiant heating tubes will be located on opposite sides of the transport deck so as to direct heat toward the top and the bottom of the waste passing along the conveyer. Additional heating tubes can be provided interior of the conveyers.

The present invention includes a flue gas recirculation means for emissions control. Ultimately, the hot gases from the pyrolization chamber are passed outwardly therefrom to a hot gas scrubber and to a quenching tower. A fuel gas compressor then serves to recirculate the gases for fuel in the radiant gas combustion chamber and other users of the produced gas. Various gases can also be removed by conventional means from the pyrolized waste so as to produce fuels for later use. The heated water from the quenching tower can then be cooled and recirculated throughout the system.

The pyrolized waste from the pyrolization chamber can then be passed to another location for disposal. The waste heat from the combustion process and also from the pyrolization process can be utilized elsewhere, potentially in association with turbines and generators.

DETAILED DESCRIPTION OF THE INVENTION

Figure 1:
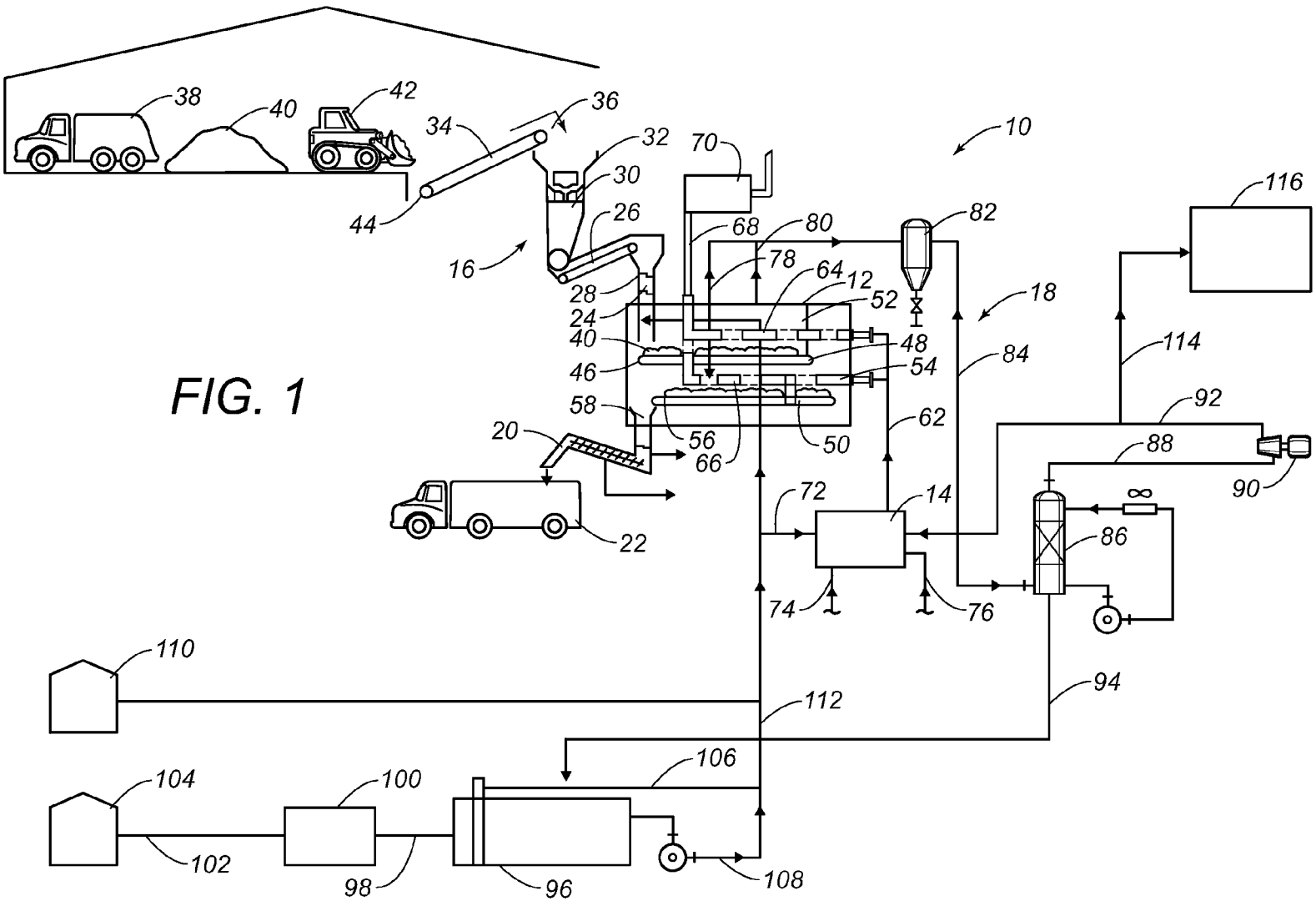
FIG. 1 is a schematic illustration of the pyrolization process of the present invention.

Referring to FIG. 1, there is shown the process 10 for pyrolization of waste in accordance with the teachings of the present invention. In particular, the pyrolization process 10 includes a pyrolization chamber 12, a combustion chamber 14, a waste supply 16, and gas treatment process 18. Each of these components interact so as to provide for the pyrolization of waste so that the waste can be conveyed through the auger-type conveyer 20 to a truck 22 for subsequent disposal.

In the present invention, the process can include a pyrolization process 12 which is separate from the combustion chamber 14. The pyrolization chamber 12 includes a waste inlet 24 generally positioned along an upper surface thereof. The waste inlet 24 includes an auger system for delivering the waste into the interior of the pyrolization chamber 12. As can be seen in FIG. 1, the waste inlet 24 includes a conveyer 26 which delivers the waste material into the auger screw-type feed system 28. A hopper 30 is in communication with the conveyor 26 so as to deliver waste which is shredded by shredder 32 onto the conveyor 26. Ultimately, the basic waste material is delivered to another conveyor 34 positioned so as to have a discharge end 36 positioned above the shredder 32. The waste is delivered on-site by a truck 38. Conventionally, the waste 40 will piled by the truck 38 and delivered by a bulldozer 42 or other delivery vehicle, onto the end 44 of conveyor 34 opposite the discharge end 36. The conveyor 34, as illustrated in FIG. 1, will elevate the waste so as to eventually discharge the waste into the shredder 32. Shredder 32 will shred the waste so that the waste will pass through hopper 30 onto conveyor 26. Ultimately, conveyor 26 will then deliver the shredded waste into the screw-type auger 28 and into the waste inlet 24 of pyrolization chamber 12.

The pyrolization chamber 12 has a transport decking arrangement 46 therein. The transport decking arrangement 46 includes conveyors 48 and 50 therein. There can be a plurality of conveyors decks, usually ranging between one and four decks. Conveyor 48 is positioned above conveyor 50. Suitable baffles 52 and 54 are provided so as to direct the waste which travels along the conveyors 48 onto the top surface of conveyor 50. Ultimately, the conveyor 50 has a discharge end 56 positioned above a residue solid outlet 58 located at the bottom of the pyrolization chamber. As the waste is pyrolized, the residue solids will pass through the residue solid outlet 58 and onto an auger-type screw conveyor 20 for discharge into vehicle 22. Suitable cooling lines, as desired, can be associated with the residue solids outlet 58 and the screw conveyor 20 so as to reduce the temperature of the residue solids as they are discharged into vehicle 22. Vehicle 22 will serve to transport the residue solids for disposal elsewhere.

The combustion chamber 14 is illustrated as separated from the pyrolization chamber 12. Ultimately, hot gases will travel along line 62 so as to introduced into heating tubes 64 and 66 located within the pyrolization chamber 12. Heating tubes 64 and 66 comprise an array of tubes that are positioned on opposite sides of the conveyor 48 and are positioned above the conveyor 50 within the interior of the pyrolization chamber 12. The heating tubes 64 and 66 will serve to pass the extremely hot gases in close proximately to the waste passing along the conveyors 48 and 50 so as to effectively pyrolize the waste thereon. The residual heat passing as gases through the heating tubes 64 and 66 will then be passed outwardly through a radiant gas outlet 68 to heat recovery system 70. The heat recovery system can be in the nature of a steam generator whereby electricity can be produced in turbines and can be used for other purposes. The radiant gases flow through the decks before going to the waste heat recovery system.

The combustion chamber 14 utilizes fuel from fuel line 72 and air from air line 74 so as to generate the hot gases. Initial start-up fuel can be passed along line 76 into the interior of the combustion chamber 14. When the fuel-air mixture is ignited within the combustion chamber 14, the ignited gases will then pass along line 62 into the heating tubes 64 and 66 within the pyrolization chamber 12. The combustion chamber 14 is designed to use produced gas, pyrolytic liquids and supplemental fuel as required for startup.

The pyrolized gases produced from the waste of the pyrolization chamber 12 are passed through pyrolized gas outlets 78 and 80 to a hot gas scrubber 82. Hot gas scrubber 82 will serve to remove particulates from the hot gas stream. Ultimately, line 84 will serve to pass the scrubbed hot gases immediately to a quench tower 86. The quench tower 86 will cool the hot gases so as to produce a liquid component and a gaseous component therefrom. The gases produced from the quench tower 86 will pass along line 88 to a fuel gas compressor 90 and then back along line 92 to the combustion chamber 14 for recycling and reuse in the combustion process. Liquids will pass along line 94 from the quench tower 86 to a multi-phase separator 96. Multi-phase separator will separate hydrocarbon and pyrolytic liquids from non-combustible liquids. The non-combustible liquids will be passed along line 98 to water treatment tank 100 and then along line 102 to a treated water storage tank 104. The hydrocarbon liquids are passed outwardly of the multi-phase separator 96 along lines 106 and 108 for hydrocarbon liquid storage 110 or for reuse in the system along line 112. The hydrocarbon liquids can serve as fuels for passing along lines 72 to the combustion chamber 14 or for recycling through the pyrolization chamber 12.

Figure 2:
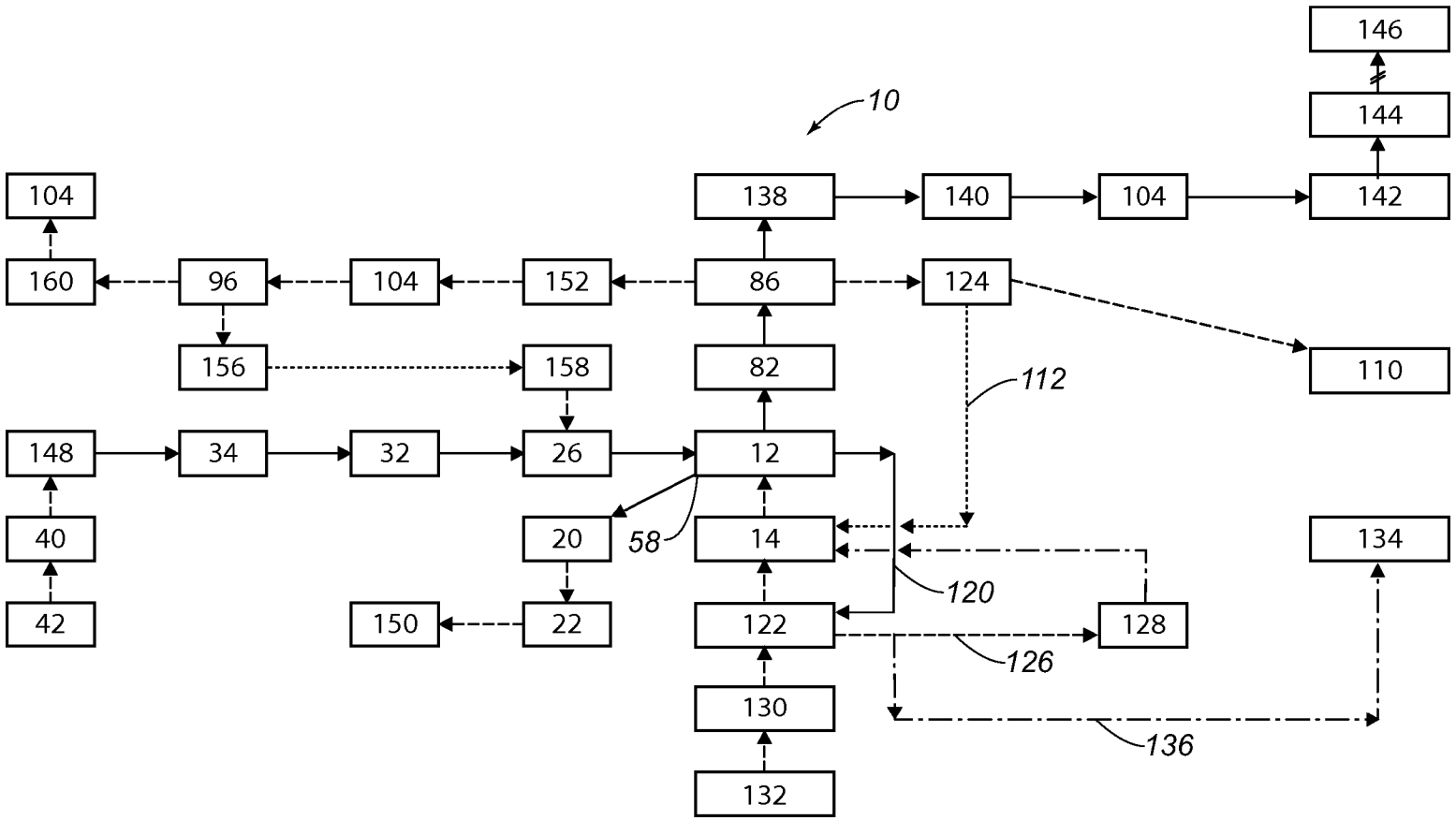
FIG. 2 is a block diagram showing the pyrolization process of the present invention.

Referring to FIG. 2, the process 10 of the present invention is illustrated in a block diagram form. Importantly, the thermal decomposition of the waste will occur in the pyrolization chamber 12. The heat for the pyrolization chamber 12 will come from the combustion chamber 14. The combustion chamber is rather interactive with the pyrolization chamber 12. In particular, waste heat can be passed along line 120 back to a waste heat exchanger 122 associated with combustion chamber 14. The hot gases from the pyrolization chamber 12 are transported to dry scrubber 82 and to the quench tower 86. A suitable compressor 124 will transport the gases and fuel to the ultimate consumer of the gases. Certain hydrocarbons can be reused by transporting along line 112 back to the combustion chamber 14. The waste heat exchanger 122 can be connected by line 126 to a recirculation blower 128 so that the waste heat can be reused by the combustion chamber 14. Combustion air for the waste heat exchanger 122 and by the combustion chamber 14 can be provided by combustion air blower. Combustion air can be provided from a tipping building or other resource 132. Any combustion gases from the waste heat exchanger 122 can be vented to atmosphere 134 along line 136.

The cool gases from the quench tower 86 can be passed to a heat exchanger 138, to a scrubber 140, and then to compressor 90. Compressor 90 will compress the gas suitably so as to be used in various forms of combustion. The fuel can be used for engine generator 144 or for other uses of the fuel such as a steam generator, co-generation systems, etc.

At the start of the process, the waste is initially delivered by the truck 38 so as to reside in a pile 40. The bulldozer 42 will serve to pass the waste 40 into a collection pit 148. The shredder 32 will shred the waste after the waste has passed along a conveyor 34 thereto. After shredding, conveyor 26 will then pass the waste into the pyrolization chamber 12.

After thermal decomposition within the pyrolization chamber 12, the residue is passed through the residue solid outlet 58 of pyrolization chamber 12 to conveyor 20. The residue is cooled during this process. Conveyor 20 will then dump the waste into a suitable container, such as located on truck 22. Truck 22 can then transport the residue to landfill 150.

The hot quench liquids from the quench tower 86 are then passed by pump 152 to an air cooler 154. This cooled liquid is then passed to the multi-phase separator 96 so as to separate the water components from the hydrocarbon components. Hydrocarbon components are then passed by pump 156 back to the storage 158 for recycling back to the combustion chamber 14. The water components are then passed through pump 160 back to treated water storage unit 104. Hydrocarbons produced by the process can be stored in hydrocarbon storage 110.

Figure 3:
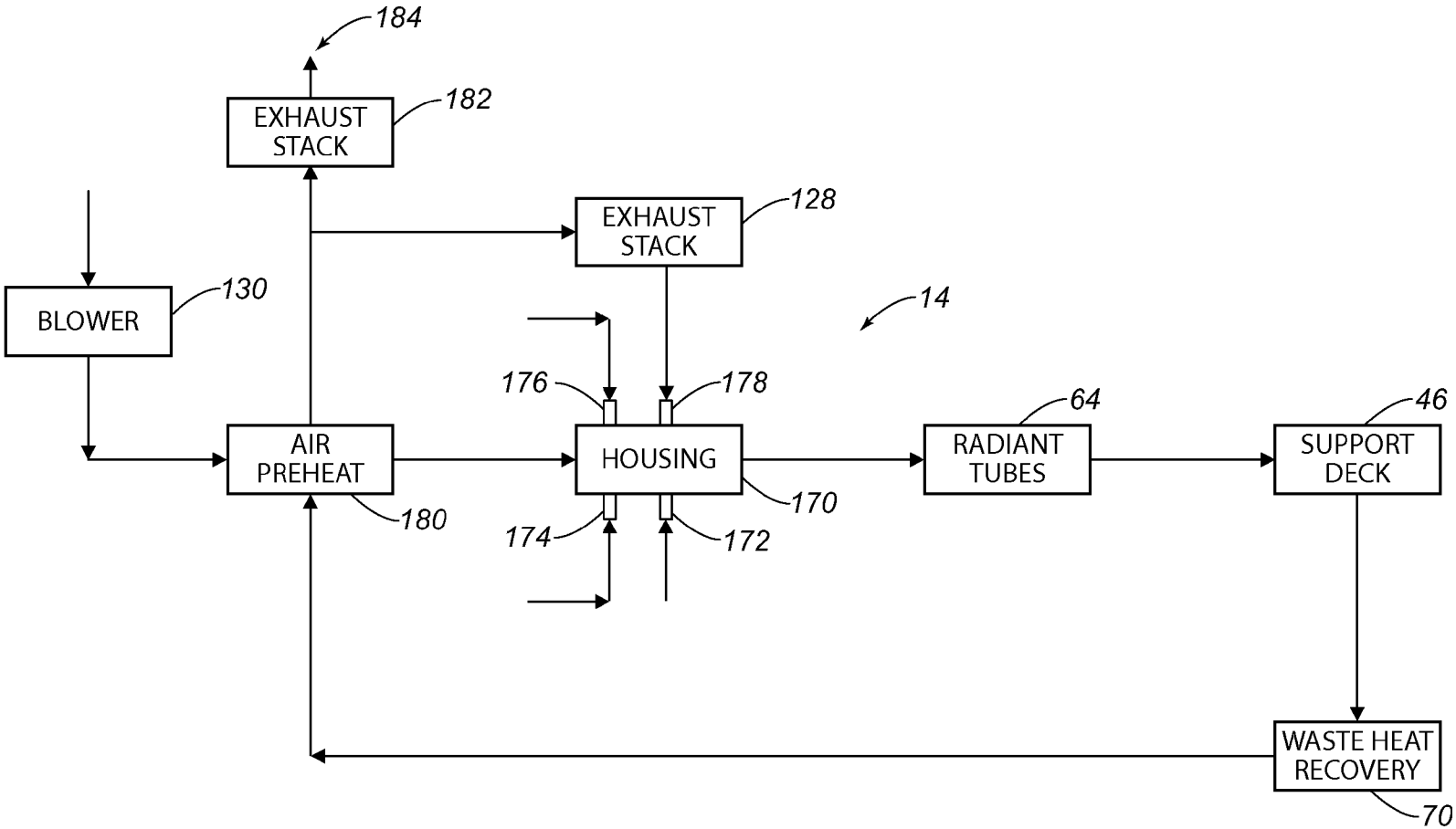
FIG. 3 is a block diagram showing the waste conversion unit as used in the process of the present invention.

FIG. 3 illustrates the waste conversion system associated with the combustion chamber 14. The combustion chamber 14 includes a housing 170 which has a supplemental fuel inlet 172 and a pyrolized liquid inlet 174. Fuel gas is provided through fuel gas inlet 176. Air is provided through air inlet 178. The gases within the housing 170 of combustion chamber 14 will create the necessary heat for delivery to the radiant tubes 64. The radiant tubes provide heat so as to pyrolize the waste as supported on support deck 46. Excess heat from the pyrolization chamber 12 is then passed to waste heat recovery 70. Such waste heat recovery can take many forms, and will vary from project to project. The air after waste heat recovery 70 passes to an air preheat area 180 associated with the blower 130. Blower 130 will pass air from the tipping building into the preheat area and then into the combustion chamber 14. After passing in heat exchange relationship within the air preheat area 180, residual air is then passed through an exhaust stack 182 and then to atmosphere 184. A recycle blower 128 will pass air into the air inlet 178 associated with housing 170 of combustion chamber 14.

Figure 4:
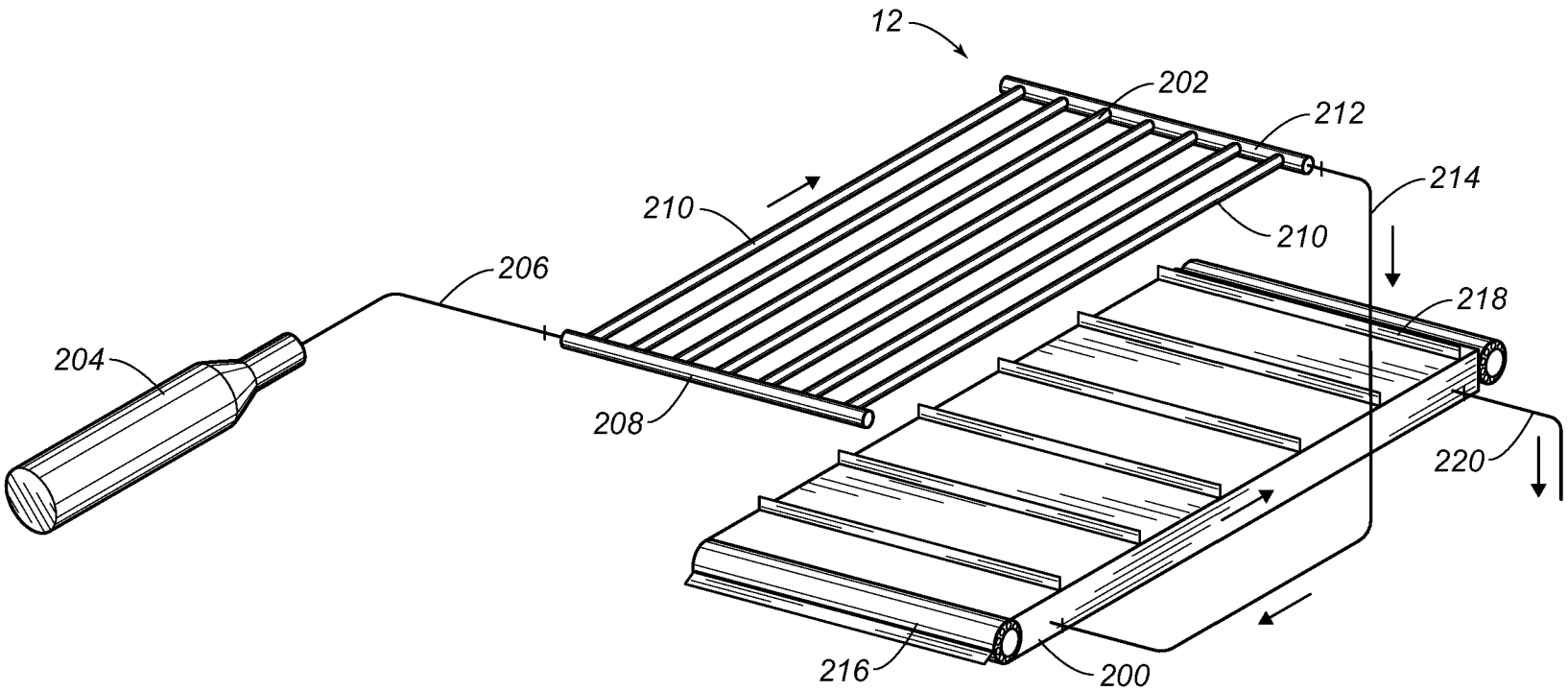
FIG. 4 is a diagrammatic illustration of a simple waste conversion unit as used in conjunction with the present invention.

FIG. 4 is a diagrammatic illustration of the interior of the pyrolization chamber 12. In particular, FIG. 4 illustrates a simple form of the present invention in which only a single deck 200 is positioned directly below an array of heating tubes 202. In particular, FIG. 4 shows that the combustion chamber 204 utilizes air and flue gas recirculation, along with fuel, to provide hot gases which pass along line 206 to the header 208 associated with the heating tubes 210 of array 202. After the gases pass through the array 202, they will be received by another header 212 at the opposite end of the tubes 210 from header 208. These gases will then pass along line 214 to flow through the deck 200, providing additional heat input to the material to be pyrolyzed.

In FIG. 4, it can be seen that deck 200 supports the conveyor 216. Conveyor 216 will cause the waste material received at end 218 thereof to pass below the array of radiant tubes 202 for pyrolization. Ultimately, the gases acting on the underside of the conveyor 216 will pass outwardly of the system through line 220.

Figure 5:
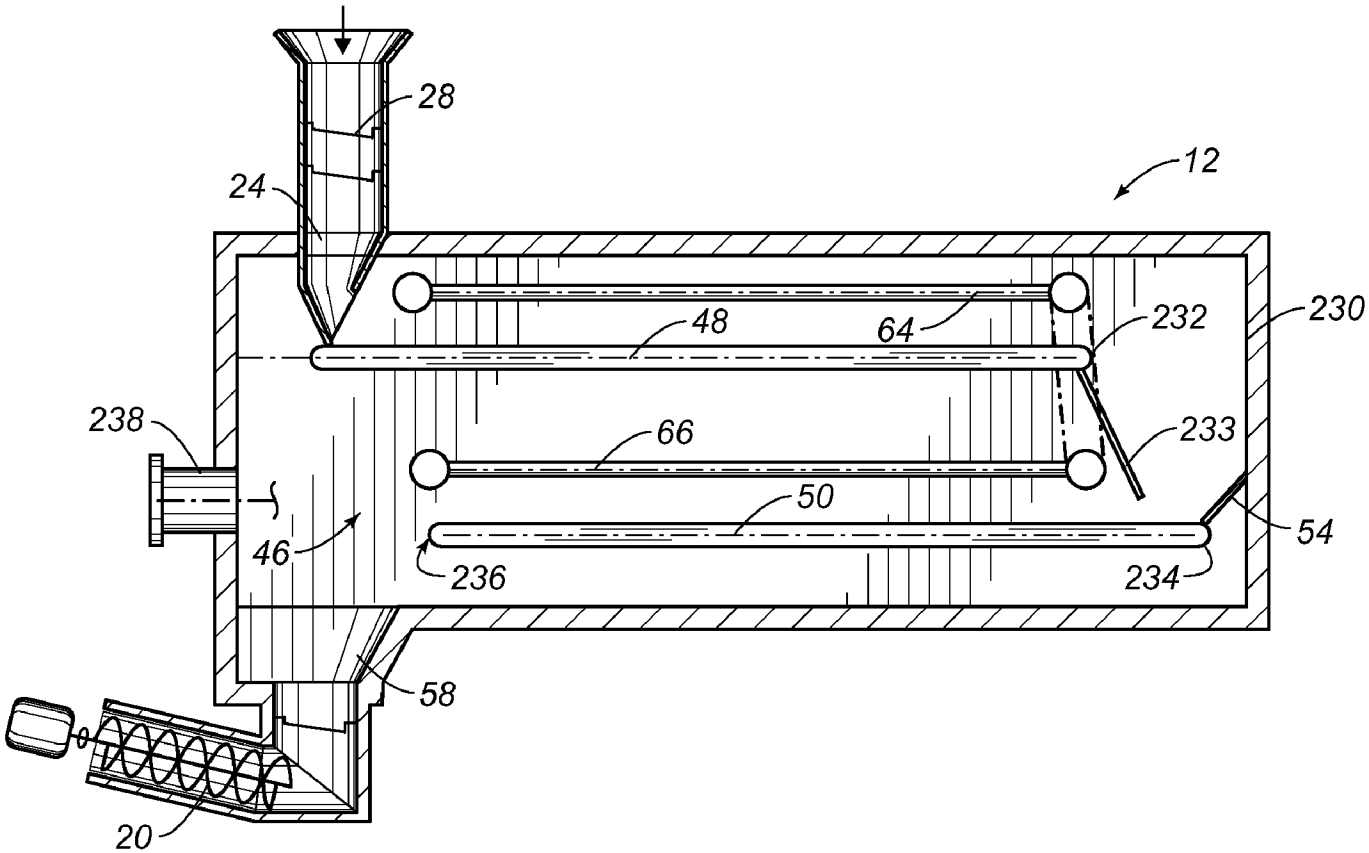
FIG. 5 is a cross-section view of the preferred form of the waste conversion unit and pyrolization chamber of the present invention.

FIG. 5 is a cross-sectional view of the pyrolization chamber 12. FIG. 5 shows the arrangement of decking 46 having conveyors 48 and 50 thereon. The array of radiant tubes 64 and 66 are illustrated as positioned on opposite sides of the conveyor 48 or positioned above the conveyor 50. The housing 230 of the pyrolization chamber 12 surrounds the tubes 64 and 66 and the conveyors 48 and 50. It illustrates the radiant gas flow in series with tubes 64 and 66, then in series with decks 48 and 50.

Initially, the auger-type screw conveyor 28 delivers the wastes through the solid inlet 24 onto the top surface of conveyor 48. Conveyor 48 will move the solids below the array tubes of 64 toward a discharge end 232. Baffles 233 and 54 will serve to move the waste residing at the discharge end 232 of conveyor 48 onto the end 234 of the conveyor 50. The waste material will then flow in direct proximity to the underside of the array of radiant tubes 66. Ultimately, conveyor 50 has a discharge end 236 which serves to discharge the residue solids through the residue solids outlet 58 and ultimately into the screw-type auger conveyor 60. The pyrolized gases will pass through pyrolized gas outlet 238 so as to be utilized within the system as described hereinbefore.

Figure 6:
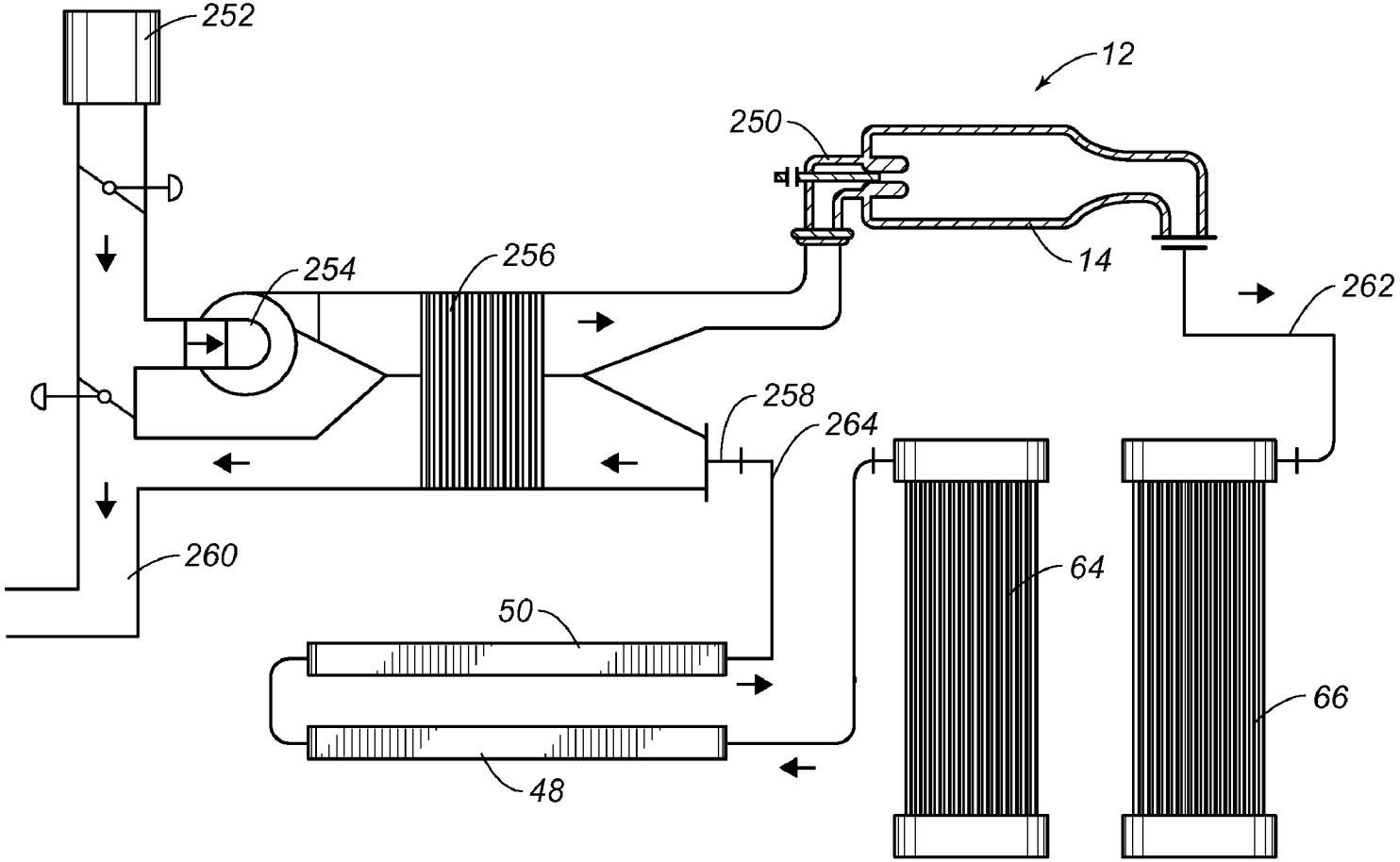
FIG. 6 is a schematic illustration of a multiple deck unit as used within the pyrolization process of the present invention.

FIG. 6 is a diagrammatic illustration of the combustion process for gases utilized by the pyrolization chamber 12. Initially, combustion chamber 14 utilizes a multi-fuel burner 250 therein. Inlet air 252 is transported by a forced draft fan 254 in heat exchange relationship with air preheater 256 prior to passing to the multi-fuel burner 250. Heated air from the pyrolization process of the present invention is passed in heat exchange relationship through the air preheater through conduit 258. After the heat exchange relationship occurs between the heated air and the inlet air, the cooled heated air is then passed through conduit 260 for venting to atmosphere.

The combustion chamber 14 will deliver heated gases through line 262 to the upper radiant coil array 64 and the lower coil radiant array 66. The heated gases will also pass through the upper transport deck 48 and the lower radiant deck 50. The heated gases from the decks 48 and 50 then pass along line 264 as hot gases back to the air preheater 256, or to other heat recovery devices.

The present invention is a significant improvement over prior processes for the pyrolization of waste. In the present invention, the radiant heat input to the pyrolytic destructive distillation unit is accomplished by utilizing an external combustion chamber instead of individual burner radiant tubes. The external combustion chamber is designed to use gaseous fuel produced in the process, combustible liquids produced in the process, and external fuel sources as start up and supplemental fuel, if required. Flue gas recirculation is incorporated to provide precise control of the external combustion and for emissions control of nitrogen oxides. The present invention serves to recycle liquids produced by the process back to the pyrolytic distillation unit. The hot gas from the pyrolytic distillation unit is rapidly cooled in a quench tower so as to minimize the production of undesirable pyrolytic products. The hot gases from the external combustion chamber are distributed into a tubular header, then into multiple pipes inside the pyrolytic distillation unit, in order to provide radiant heat for the destructive distillation process. Hot gases also flow through the decks used for the transport of the feed solids. This provides additional heat input into the feed and improves system efficiency. The pyrolytic distillation unit can have one, two or more levels of exposure to the radiant heat in a single pyrolytic distillation unit. Waste heat recovery and/or air preheat is utilized depending on the power generation method. The solids transport decks have variable speed drives to control exposure time within the pyrolytic distillation unit.

The foregoing disclosure and description of the invention is illustrative and explanatory thereof. Various changes in the details of the described method or in the illustrated system can be made within the scope of the present invention without departing from the true spirit of the invention. The present invention should only be limited by the following claims and their legal equivalents.

I claim:

1. A system for the pyrolization of waste comprising:

a combustion chamber having a fuel inlet and a hot gas outlet;

a pyrolization chamber separated from said combustion chamber, said pyrolization chamber connected to said hot gas outlet of said combustion chamber, said pyrolization chamber having a waste inlet and a pyrolized waste outlet, said pyrolization chamber comprising:

a housing having an interior volume, said pyrolized waste outlet opening at a bottom of said housing; and a plurality of radiant tubes in fluidic connection with said hot gas outlet of said combustion chamber; and a conveyor means positioned in said pyrolization chamber, said conveyer means for moving waste from said waste inlet through said pyrolization chamber to said pyrolized waste outlet, said conveyer means comprising:

a first conveyer having one end adjacent said waste inlet such that waste can be deposited thereon, said plurality of radiant tubes positioned over said first conveyor so as to direct heat toward a top surface of said first conveyor; and a deck with a surface supporting said first conveyor thereon, said deck having an interior volume, said plurality of radiant tubes in fluidic connection with said interior volume of said deck such that said hot gases from said plurality of radiant tubes can pass into said deck so as to transfer heat to said surface of said deck and to said first conveyor extending thereover.

2. The system of claim 1, said pyrolization chamber further comprising:

a second conveyor positioned below said first conveyor, said second conveyor having an end adjacent said pyrolized waste outlet.

3. The system of claim 2, further comprising:

another plurality of radiant tubes positioned in said housing between said first conveyor and said second conveyor, said another plurality of radiant tubes being fluidically interconnected to said hot gas outlet of said combustion chamber.

4. The system of claim 3, further comprising:

a baffle means positioned in said housing at an opposite end of said first conveyor, said baffle means for directing waste from said opposite end of said first conveyor onto said second conveyor.

5. The system of claim 1, further comprising:

flue gas treatment means connected to said pyrolization chamber, said flue gas treatment means for treating gas emitted from said pyrolized waste from said pyrolization chamber.

6. The system of claim 5, said pyrolization chamber having a gas outlet, said flue gas treatment means comprising:

a quenching tower connected to said gas outlet; and a gas scrubber connected to said gas outlet.

7. The system of claim 6, said pyrolization chamber having a gas outlet, said flue gas treatment means comprising:

a gas separator means connected to said gas outlet and interconnected to said gas inlet of said combustion chamber, said gas separator means for passing a fuel gas into said combustion chamber.

8. The system of claim 1, said combustion chamber comprising:

a housing having a fuel inlet and said hot gas outlet therein;

a burner means cooperative with an interior said housing for igniting fuel from said fuel inlet; and a blower means interactive with said housing for forcing air through said housing and for forcing hot gas outwardly of said housing through said hot gas outlet.

9. The system of claim 1, further comprising:

a conveyor means connected to said pyrolized waste outlet of said pyrolization chamber, said conveyor means for transporting pyrolized solid waste from said pyrolization chamber to a location external of said pyrolization chamber.

10. A method of pyrolizing waste comprising:

igniting a fuel gas in a combustion chamber so as to produce a hot gas;

forming a pyrolization chamber having a plurality of radiant tubes positioned over a conveyor supported on a deck within said pyrolization chamber;

passing the hot gas through said plurality of radiant tubes within said pyrolization chamber so as to elevate a temperature within said pyrolization chamber;

passing the hot gas from said plurality of radiant tubes through an interior of said deck so as to transfer heat from said deck to said conveyor thereon;

conveying solid waste on said conveyor through said pyrolization chamber so as to be continuously heated by the elevated temperature within said pyrolization chamber and by heat transfer from said conveyor;

interacting the solid waste with the elevated temperature within said pyrolization chamber and with the transferred heat from said conveyor so as to pyrolize the waste within said pyrolization chamber;

passing hot gasses from said deck outwardly of said pyrolization chamber; and removing solid pyrolized waste from said pyrolization chamber.

11. The method of claim 10, further comprising:

positioning said combustion chamber so as to be separate from said pyrolization chamber; and connected a hot gas outlet of said combustion chamber to a hot gas inlet of said pyrolization chamber.

12. The method of claim 10, further comprising:

passing the hot gas through a plurality of radiant tubes within said pyrolization chamber, said step of conveying comprising moving the solid waste adjacent to the radiant tubes within said pyrolization chamber.

13. The method of claim 10, said step of conveying comprising:

conveying pyrolized solids toward a pyrolized solids outlet of said pyrolization chamber; and depositing the conveyed pyrolized solids at said pyrolized solids outlet.

14. The method of claim 10, further comprising:

separating fuel gases from said hot gases; and recirculating said fuel gases to said combustion chamber.

15. The method of claim 10, further comprising:

scrubbing the hot gases external of said pyrolization chamber; and quenching the scrubbed hot gases.

16. The method of claim 10, said step of igniting comprising:

blowing air through said combustion chamber;

mixing the blown air with the ignited fuel in said combustion chamber; and forcing the ignited fuel and the blown air outwardly of said combustion chamber and into said pyrolization chamber.

* * * * *